US007841543B2

(12) United States Patent
Gruber

(10) Patent No.: US 7,841,543 B2
(45) Date of Patent: Nov. 30, 2010

(54) TIE FOR A BALLASTED TRACK

(75) Inventor: Hermann Gruber, Neuhaus (AT)

(73) Assignee: SSL-Schwellenwerk und Steuerungstechnik Linz GmbH, Vienna (AT)

( * ) Notice: Subject to any disclaimer, the term of this patent is extended or adjusted under 35 U.S.C. 154(b) by 784 days.

(21) Appl. No.: 10/589,634

(22) PCT Filed: Feb. 14, 2005

(86) PCT No.: PCT/AT2005/000046

§ 371 (c)(1),
(2), (4) Date: Aug. 7, 2007

(87) PCT Pub. No.: WO2005/078195

PCT Pub. Date: Aug. 25, 2005

(65) Prior Publication Data

US 2008/0099571 A1 May 1, 2008

(30) Foreign Application Priority Data

Feb. 16, 2004 (AT) ..... A 238/2004

(51) Int. Cl.
*E01B 9/14* (2006.01)

(52) U.S. Cl. ..... 238/29

(58) Field of Classification Search ..... 238/29, 238/30, 54, 55, 83
See application file for complete search history.

(56) References Cited

U.S. PATENT DOCUMENTS 830,287 A 9/1906 Benjamin
1,020,973 A 3/1912 Frisholm
1,244,813 A * 10/1917 Williams ..... 238/30
1,381,251 A * 6/1921 Sweeney ..... 238/30
1,410,185 A * 3/1922 Ickes ..... 238/35

(Continued)

FOREIGN PATENT DOCUMENTS

AT 408 774 B 3/2002

(Continued)

OTHER PUBLICATIONS

International Search Report.

*Primary Examiner*—S. Joseph Morano
*Assistant Examiner*—Robert J McCarry, Jr.
(74) *Attorney, Agent, or Firm*—Collard & Roe, P.C.

(57) ABSTRACT

The invention relates to a sleeper (1) for a gravel-mounted structure in railways, which has a cross member (4) extending along a sleeper longitudinal axis (6) and two longitudinal members (5) spaced apart from one another by the cross member (4), and each longitudinal member (5) has a bearing (9) extending on a top face for mounting a rail element (10) above the longitudinal member (5). Each longitudinal member (5) has one or more mounting devices (26) for a rail fixing element (28) each for retaining a rail element (10) on the longitudinal member (5) and at least one of the mounting devices (6) is disposed transversely offset from the sleeper longitudinal axis (6) on at least one of the two longitudinal members (5). The invention further relates to a sleeper (1) of this type which is of a stepped or recessed design at the ends of the longitudinal members (5), to enable connecting elements (56) to be fitted in these regions in order to secure two rail elements (10) lying end to end.

20 Claims, 3 Drawing Sheets

U.S. PATENT DOCUMENTS

| | | | | | |
|---|---|---|---|---|---|
| 1,426,828 | A | * | 8/1922 | Farnham | 238/55 |
| 1,696,662 | A | * | 12/1928 | Wills | 238/30 |
| 1,795,817 | A | | 3/1931 | Yeomans | |

FOREIGN PATENT DOCUMENTS

| | | | |
|---|---|---|---|
| AT | 410 226 | B | 3/2003 |
| CH | 40 591 | A | 8/1908 |
| DE | 93 05 22 | C | 7/1955 |
| DE | 42 36 191 | A1 | 5/1994 |
| DE | 296 11 823 | U1 | 10/1996 |
| DE | 199 57 223 | A1 | 6/2001 |
| DE | 100 23 389 | A1 | 11/2001 |
| DE | 102 54 973 | A1 | 6/2004 |
| EP | 0 495 268 | A1 | 7/1992 |
| WO | WO 01/79610 | A | 10/2001 |

* cited by examiner

TIE FOR A BALLASTED TRACK

CROSS REFERENCE TO RELATED APPLICATIONS

Applicant claims priority under 35 U.S.C. §119 of Austrian Application No. A 238/2004 filed Feb. 16, 2004. Applicant also claims priority under 35 U.S.C. §365 of PCT/AT2005/000046 filed Feb. 14, 2005. The international application under PCT article 21(2) was not published in English.

The invention relates to a sleeper.

Sleepers for a gravel-mounted structure on railways are already known from the prior art, which extend underneath and transversely between the laid rails and support them on beds. When a rail vehicle travels over them, such sleepers enable the resultant longitudinal and lateral forces to be absorbed and directed into the sleepers so that a track geometry and in particular the track distance defined by the wheel base of the rail vehicles can be preserved in order to ensure a stable track position. Due to the increasing amount of stress placed on the sleepers, e.g. caused by higher transport loads, speeds and braking forces of rail vehicles and narrower radii of curvature of the tracks, it is necessary to find a better system for absorbing the resultant forces and directing them into the substructure or sleepers, for which purpose sleepers are needed which are inexpensive to produce and at the same time more reliable during operational service.

From the prior art, patent specification DE 100 23 389 A1 describes a sleeper for the gravel-mounted structure of railway tracks. The sleeper disclosed in this document is provided with arms extending transversely underneath the tracks, the bottom faces of which lie in a same plane as the sleeper bottom face. As a result of these transverse arms, therefore, the sleeper is provided with a bigger bearing surface overall on the gravel and on the substructure, which makes it more difficult for the sleeper to sink in the gravel and stabilises the sleeper to prevent it from tilting about its longitudinal axis. The tracks in this instance lie on bearings, which are mounted on the top face of the transverse arms and the tracks are respectively held in position, at least in the transverse direction with respect to the track, by two track fixing means disposed to the side of the bearings.

The disadvantage of the system disclosed in DE 100 23 389 A1 is that only two track fixing means are provided for each track bed, which are disposed in the region of a sleeper longitudinal axis. In track sections subjected to high stress, such as sections of curved track, uphill sections or sections on which heavy loads are transported, the two track fixing means are not able to afford sufficient resistance to the high shifting forces of the tracks under certain circumstances and above average distortion of the tracks results in a safety risk due to possible damage to the railway track. The problem of increased shifting forces on the tracks occurs in particular in the case of rail vehicles with eddy current brakes, which are becoming increasingly common.

Also known from the prior art are what are known as "frame sleepers" formed by sleepers extending between the tracks, which area connected to a component underneath the tracks by means of a longitudinal support. A frame sleeper of this type is known from patent specification DE 102 54 973.7. Each of the tracks lies respectively on a top face of the sleepers so that the frame sleeper has four beds and track fixing means are mounted on each bed at specific mounting positions. Three such mounting positions are provided, "outer", "middle" and "inner", each of which comprises a pair of oppositely lying track fixing means. The fixing points in the region of each bed can be varied by providing pairs of track fixing elements.

The disadvantage of frame sleepers of this type is that, because of the four beds provided for the track elements, the frame sleeper as a whole is statically undefined, which means that a very high dimensional accuracy is necessary during the manufacturing process in order to obtain an identical vertical position of the four beds whilst conforming to lower dimensional tolerances, because even slight variances in dimension can lead to fracturing of the sleeper. In order to prevent this, it is necessary to produce the frame sleeper using special or complex production processes.

What can be said generally about sleepers of the type know from the prior art is that although sleepers with transverse arms offer better service properties due to the fact that they afford a larger support surface on the gravel and are inexpensive to produce, they are not able to afford sufficient resistance to warping of the track. In the case of frame sleepers, on the other hand, the resistance opposing track warping can be adapted to different load situations by varying the mounting positions of the track fixing means, but frame sleepers are more complex to produce and maintenance costs are significantly higher than is the case with simple sleepers. In the past, it has not been possible to obtain a variable positioning of the track fixing means on simple sleepers of the type disclosed in patent specification DE 100 23 389 A1 known form the prior art, for example, due to the unsuitable geometry of the transverse arms and track supports.

The objective of the present invention is to propose a sleeper for a gravel-mounted structure on railway tracks which is inexpensive to manufacture and lends itself to flexible track building. A part-objective of the invention is to propose a sleeper which lends itself to improved and variable absorption of track lateral and longitudinal forces, thereby improving the service properties of railway tracks. Another part-objective of the invention is to enable a connecting element to be mounted on the sleeper in the laid state in order to connect two consecutive track elements.

This objective is achieved independently by the invention on the basis of the features defined in the claim. The resultant advantage resides in the fact that, because the support systems and the fixing or clamping points on the track elements are disposed in an offset arrangement transversely to the longitudinal mid-axis of the sleeper, the track lateral and longitudinal displacement forces generated are absorbed and directed away more efficiently because there is no need to preserve the sleeper distance between the adjacently lying rail fixing elements of two adjacent sleepers and instead, shorter fixing distances can be maintained between the track fixing elements as viewed in the direction in which the track is run. The fixing or clamping points at which the track fixing elements secure the co-operating track element can therefore be uniformly or non-uniformly distributed along the course of the track depending on the load situation and sections along the course of the track in which no track fixing elements are provided are significantly shorter. The rail support and the track body as a whole can be made generally stronger as a result.

The advantage of certain characterising features is that the distance between two adjacent rail fixing elements of two adjacent sleepers can be reduced or if necessary increased with respect to a sleeper distance between the sleeper longitudinal axes. Longitudinal and lateral shifting forces of the rail elements can therefore be better absorbed across the rail extension, adapted to the load situation of the sleeper, and directed into the gravel, and the lateral shifting resistance opposing a longitudinal displacement of the rail elements can be increased by providing more than two rail fixing elements per longitudinal support.

As a result of the combination of certain features, the rail elements can advantageously be secured on the longitudinal support on either side in the region adjacent to the bearing.

Certain features are of advantage because the fact that three, two or one mounting device(s) is or are provided on each side adjacent to the bearing means that a total of six, four or two rail fixing elements can be fitted on each longitudinal member of the sleeper. The sleeper can therefore be adapted depending on the number of rail fixing elements provided on them to cater for different applications, such as straight runs, radii of curvature, uphill sections or sections with high transport loads and such like.

As a result of certain features, the sleeper can be individually adapted to respective load situations by activating or deactivating the mounting devices. The layout of the rail fixing elements can therefore be decided on site when laying a railway track, thereby enabling a variable disposition of the rail fixing elements.

The mounting device described advantageously offers the possibility of being able to fit rail fixing elements known from the prior art on the mounting devices, for example a spring-based, shoulderless W-fixture.

Also of advantage are certain features, by means of which a closure element, such as a plug made from plastic can easily be used to deactivate mounting devices which are not needed by closing the anchoring orifices.

Certain features are of advantage because the sleeper can be prepared for railway sections with normal or medium loads by providing two rail fixing elements, which are preferably positioned diagonally opposite one another. In this first mounting position, there is a constant distribution of rail fixing elements along the rail extension and a fixing distance between two adjacent rail fixing elements of two adjacent sleepers may be shorter than their sleeper distance.

Also of advantage are certain features, whereby in the second mounting position, a total of three rail fixing elements per longitudinal member is provided and the co-operating mounting devices and fixing and clamping points of the rail elements on the longitudinal member are disposed in an essentially triangular shape. This layout of the rail fixing elements is of advantage in the case of sections where the rail elements are subjected to increased lateral shifting forces, for example at tight radii of curvature.

An embodiment of the sleepers is of advantage because in a third mounting position, a total of four rail fixing elements per longitudinal member is provided, thereby enabling the sleeper to be used on sections subjected to very high loads.

The advantage of certain features is that if the two rail elements extending across the sleeper are subjected to differing loads, for example in curved sections, the longitudinal and lateral forces generated can be absorbed on an individually adapted basis by the two longitudinal members, i.e. the lateral shifting resistance which occurs when subjected to load can be fixed individually at the separate rail elements by providing an appropriate number of rail fixing elements and by adopting an appropriate layout of the rail fixing elements, thereby guaranteeing a stable position of the mutually parallel rail elements.

The features specified in the claims relate to another independent solution to the objective addressed by the invention. The advantage of this solution is that because the longitudinal member is of a stepped or recessed design in the region of the end faces underneath the rail elements, a gap is left free between the rail bottom face and a top step face when laying the railway track. This enables two individual rail elements between two adjacent sleepers to be connected, preferably by a rail weld, because the bottom faces of the rail element can be accessed by appropriate tools in a connecting region. As a result of using a sleeper proposed by the invention, therefore, a distance between two rail connections is the same as the distance between two adjacent sleepers. This enables very short sections of track to be built more economically and more flexibly.

Certain features are of advantage because the gap is easy to create from a structural point of view and enables a process to be performed in order to fit connecting elements, in particular welded connections, using appropriate tools.

Certain features define an advantageous stepped geometry by means of which a large bearing surface can be achieved at the bottom face of the sleeper so that the sleeper load is directed as evenly as possible into the gravel bed.

Certain features are of the advantage because the mounting channels provided in the support surface can extend across a wide region, in particular between step edges or across the sleeper width, beyond the respective longitudinal member. As a result of this layout of the mounting channels, rail fixing elements known from the prior art may be used, which have an anchoring part engaging in the mounting channels, and these may also be disposed eccentrically with respect to the sleeper longitudinal axis in order to make use of the advantages of an eccentric layout of this type, described above.

The advantage of the embodiment of a bearing described herein is that a large bearing surface is obtained for the bottom face of the rail element, which means that resistance to lateral shifting counteracting the longitudinal shifting forces of the rail element can be increased.

The invention will be described in more detail below with reference to examples of embodiments illustrated in the appended drawings.

Of these:

Figure 1:
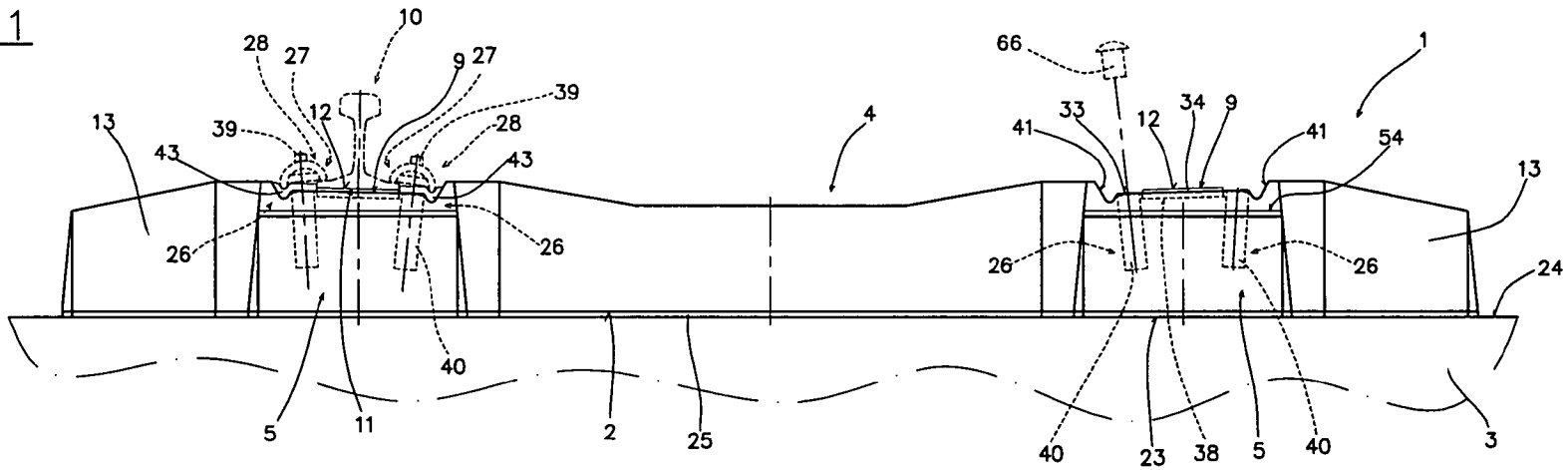
FIG. 1 is a front view of a sleeper proposed by the invention.

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc., relate to the drawing specifically being described and can be transposed in terms of meaning to a new position when another position is being described. Individual features or combinations of features from the different embodiments illustrated and described may be construed as independent inventive solutions or solutions proposed by the invention in their own right.

Figure 2:
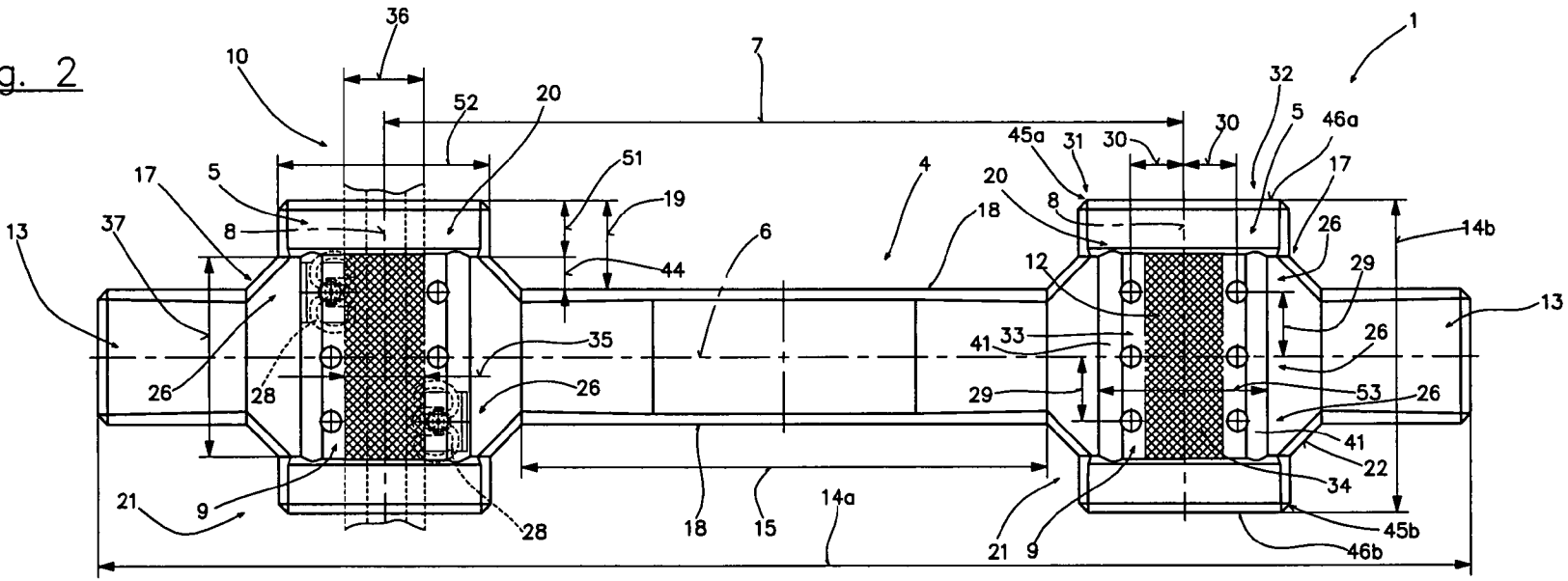
FIG. 2 is a plan view of the sleeper illustrated in FIG. 1.
Figure 3:
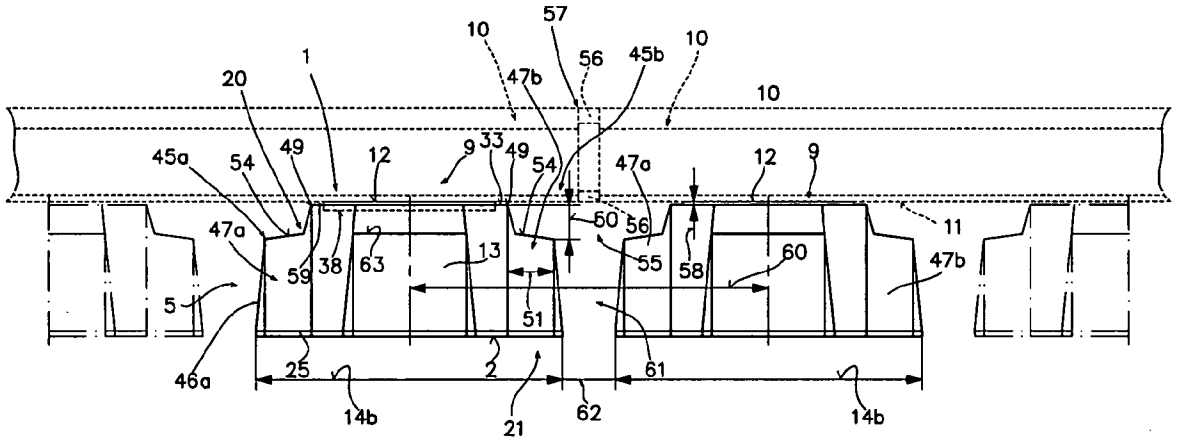
FIG. 3 is a side view of the sleeper illustrated in FIG. 1 and FIG. 2.

FIGS. 1 to 3 illustrate an example of an embodiment of a sleeper 1, preferably for a gravel-mounted structure in railway tracks, which sleeper 1 is positioned in the laid state on a gravel bed 3 or on a solid road by means of a sleeper bottom face 2. The sleeper 1 has a cross member 4 connecting two longitudinal members 5 to one another, and the cross member 4 extends along a sleeper longitudinal axis 6 of the sleeper 1 between the longitudinal members 5 and spaces the longitudinal members 5 at a distance 7 apart from one another. The longitudinal members 5 extend along a longitudinal mid-axis 8 lying in the rail extension and the latter extends transversely to the sleeper longitudinal axis 6 of the sleeper 1, preferably at a right angle to it so that the sleeper 1 is formed in the manner of a double cross sleeper. The sleeper 1 is preferably provided in the form of a monolithic steel and pre-stressed concrete finished part, which may have reinforcements extending along and/or transversely to the sleeper longitudinal axis 6.

Disposed on each of the two longitudinal members 5 is a bearing 9 on which a rail element 10 of a railway track lies when the sleeper 1 is in the laid state. The rail elements 10 extend transversely and parallel with one another across the sleeper 1, so that the sleeper 1 is disposed underneath the rail elements 10 in the laid state and the longitudinal members 5 extend along their longitudinal mid-axis 8 underneath the rail elements 10. The extension of the longitudinal mid-axis 8 of the longitudinal members 5 therefore essentially corresponds to the extension of the rail elements 10 in the state mounted on the sleeper 1. The distance 6 between the longitudinal axes 8 of the longitudinal members 5 corresponds to a rail distance between the individual rail elements 10 so that they extend lying on the bearing 9 in the region of the longitudinal members 5 in this mounted state on the sleeper 1. The bearings 9 extend on the longitudinal members 5 at least in the region lying around the longitudinal mid-axis 8 and a bottom face 11 of each rail element 10 lies on a bearing surface 12 on the bearing 9 remote from the sleeper bottom face 2.

At its end regions lying in the extension of the sleeper longitudinal axis 6 to the side of the longitudinal members 5, the sleeper 1 may respectively have transverse extensions 13 so that a sleeper length 14*a* may conform to the standard dimension for sleepers 1 known from the prior art, and a sleeper width 14*b* denotes the extension length of the longitudinal members 5 transversely to the sleeper longitudinal axis 6 of the sleeper 1. Furthermore, the dimensions of a cross member length 15 of the cross member 4 and a width 16 of the cross member 4, which may also correspond to a width of the transverse extension 13, may be selected to permit the use of standard laying and packing equipment and techniques known from the prior art for laying railway tracks.

In the intersecting regions 17 between the cross member 4 and the longitudinal member 5, the longitudinal members 5 are preferably designed so that they project out from the extension of the rails on either side along their longitudinal mid-axis 8, in which case longitudinal projections 20, 21 extend out beyond a side face 18 of the cross member 4 by a distance 19. Due to the enlargement of an external contour 22 of the sleeper 1, therefore, a larger bearing surface 23 is created at the sleeper bottom face 2, which is placed in abutment with a top face 24 of the gravel bed 3 during laying. With regard to the sleeper bottom face 2, it should be pointed out that one or more damping mats 25 may be mounted on it, which may be made from a deformable or elastic material, so that the sleeper 1 is able to adapt to the surface structure of the gravel bed 3 to a certain degree and can sink into it so that, because of a larger contact surface and a vibration-damping effect of the damping mat 25, forces will be distributed more uniformly and more efficiently into the gravel bed 3 when a wheel set of a rail vehicle rolls over the sleeper 1. The damping mat 25 also delays any sinking of the track body as a whole in the gravel bed 3, which means that periods between track maintenance will be longer and the cost of maintaining the railway track reduced during its entire service life.

For the purpose of the invention, the longitudinal members 5 have one or more mounting devices 26, which mounting devices 26 are respectively provided as a means of retaining and securing a rail fixing element 28 in position. The rail fixing elements 28 are designed to secure the rail elements 10 on the bearing 9, for which purpose the rail fixing elements 28 fix the position of the rail elements 10 at fixing or clamping points 27 on the respective longitudinal member 5 at least in a rail transverse direction. The mounting devices 26 and the rail fixing elements 28 and the fixing and clamping points 27 of the rail elements 10 lie in the longitudinal extension of the track in a same plane extending at a right angle to the longitudinal track extension, for example.

The mounting devices 26 are disposed on the longitudinal member 5 in such a way that at least one of the mounting devices 26 and/or fixing and clamping points 27 is spaced along the longitudinal mid-axis 8 of the longitudinal member 5 apart from the sleeper longitudinal axis 6 of the sleeper 1 by a distance 29, i.e. at least one of the mounting devices 26 and/or fixing and clamping points 27 is disposed eccentrically with respect to the sleeper longitudinal axis 6 of the sleeper 1.

In the embodiment illustrated as an example, in the transverse extension with respect to the longitudinal mid-axis 8 of the longitudinal member 5, the mounting devices 26 are spaced apart from the latter by a distance 30. At least one of the mounting devices 26 is provided for the two sides 31, 32 lying adjacent to the longitudinal mid-axis 8 of the longitudinal members 5. At least two mounting devices 26 per longitudinal member 5 may be disposed offset from one another in the extension of the longitudinal mid-axis 8 of the longitudinal member 5, in which case the distances 29 of the mounting devices 26 from the sleeper longitudinal axis 6 of the sleeper 1 may be different and/or the mounting devices 26 may be spaced apart from the sleeper longitudinal axis 6 of the sleeper 1 in opposite directions from one another. This enables different and if necessary non-symmetrical distributions of the mounting devices 26 relative to the sleeper longitudinal axis 6 of the sleeper 1 to be obtained on each longitudinal member 5.

The mounting devices 26 and the bearing 9 are respectively disposed on the longitudinal member 5 on a respective support surface 33 on a top face of the longitudinal member 5 which faces the direction remote from the sleeper bottom face 2. The bearing 9 may be provided in the form of a damping element 34 in each case, which incorporates the bearing surface 12 for supporting the bottom face 11 of one of the rail elements 10. The bearing surface 12 is designed so that when a rail element 10 is mounted, the contact with the bottom face 11 of the rail element 10 occupies a large surface area, for which purpose the bearing surface 12 has a bearing width 35 which preferably essentially corresponds to a rail width 36 and the bottom face 11 lies flat on the bearing 12 by means of a bearing length 37. The bearing 9 is preferably positioned and secured in a recess 38 in the support surface 33 matching the bearing width 35 and the bearing length 37. The damping element 34 inserted in the recess 38 may be made from a flexible, preferably elastic material so that when a wheel set rolls over the sleeper 1, any vibrations or shaking generated can be absorbed. Another option is for the bearing 9 to be made from an essentially rigid material, in which case damping means for absorbing vibrations can be provided separately from the bearings 9. The bearing 9 may also be of a multi-part design. Generally speaking, materials and bearing layouts for mounting rail elements are known from the prior art and will therefore not be described in any further detail here.

The bearing width 35 of the bearings 9 lies within the sum of the distances 30 by which the mounting devices 26 are spaced apart at the two sides 31, 32 of the longitudinal member 5 adjacent to its longitudinal mid-axis 8. A bearing length 37 and a length of the recess 38 is preferably bigger in the longitudinal extension along the longitudinal mid-axis 8 of the longitudinal member 5 than the width 16 of the cross member 4 or transverse extension 13. As illustrated by the embodiment shown in FIG. 2, this results in a rectangular bearing surface 12 on the bearing 9 and the dimension of the bearing width 35 as well as the distances 30 by which the mounting devices 26 are spaced apart from the longitudinal mid-axis 8 of the longitudinal member 5 are defined by a rail width 36 of the rail elements 10. In this respect, the rail width 36 is a standard size for the region in which the railway is built and these dimensions are therefore essentially pre-set standards.

In respect of the bearing 9, it should also be pointed out that it preferably extends continuously across the bearing length 37 and the bearing length 37 extends across at least a half, in particular ⅔, of the sleeper width 14*b* of the sleeper 1, for example. The bearing surface 12 is at least slightly raised with respect to the support surface 33 of the longitudinal member 5. The bearing 9 is therefore disposed so that it extends essentially at the centre on the longitudinal member 5 in the direction of its longitudinal mid-axis 8, and in addition to a rectangular shape, the bearing surface 12 may also have an elliptical shape. The mounting devices 26 are preferably disposed along the longitudinal extension of the bearings 9, on either side of and adjacent to them.

The mounting devices 26 are respectively designed for mounting a rail fixing element 28, these rail fixing elements 28 being known from the prior art. The rail fixing elements 28 illustrated in FIGS. 1 and 2 as examples are provided in the form of a clamp-type fixing element biased by a spring force, for example a shoulderless W-fixing means. Accordingly, it has a bolt 39 designed to be accommodated by the mounting device 26. The mounting device 26 preferably has an anchoring orifice 40 in which the rail fixing element 28, in particular its bolt 39, is secured in position but preferably in a releasable arrangement. If necessary, the mounting device 26 has a mounting channel 41 extending respectively adjacent to the anchoring orifice 40 and in which an anchoring part 43 of the rail fixing element 28 which may be provided positively engages to provide a fixed positioning. Fixing dowels may be accommodated in the anchoring orifices 40, for example, through which the bolts 39 are inserted, in a manner already known from the prior art. With respect to the function of the rail fixing elements 28, it should be pointed out that they apply a clamping force to projections at the base end of the rail elements 10 at fixing or clamping points 27, so that the rail elements 10 are clamped at each side between oppositely lying mounting devices 26. When the clamping force acting on the rail elements 10 extending transversely to the sleeper 1 or the lateral motion resistance is exceeded by longitudinal and lateral forces generated by load on the rails, the rail element 10 is pushed or warped along the rail extension.

With regard to the rail fixing elements 28, it should be pointed out that the invention is not restricted to the type illustrated in the drawings and instead, the mounting devices 26 may be designed so that other designs of rail fixing elements known from the prior art can be mounted by them. For example, known rail fixing elements 28 made by the manufacturer PANDROL® such as the "FASTCLIP 1501", "FASTCLIP 1505" and "E-CLIP" types may be used with the present invention or alternatively those made by the manufacturer Vossloh® including the "W14" and "E14" types or by the manufacturer Promorail® of the "PR3" type.

In the embodiment illustrated in FIG. 2, the length of the mounting channels 41 expediently corresponds to the bearing length 37 of the bearing 9, and a mounting channel 41 extends on both sides and preferably parallel adjacent to the bearing 9 in each case and the anchoring orifices 40 of the mounting devices 26 are disposed between the mounting channel 41 and the bearing 9.

The bearings 9 and the mounting channels 41 may extend beyond the cross member 4, in particular the side face 18, by means of a protuberance 44 along the extension of the longitudinal member 5 on either side. The mounting channel 41 may extend continuously, matching the bearing length 37 of the bearing 9 in the support surface 33 of the longitudinal member 5 or is split into several sections along the longitudinal extension of the longitudinal member 5, in which case a channel section must be disposed adjacent to each anchoring orifice 40. As a result of the protuberance 44 in the longitudinal extension of the mounting channel 41 and the bearing 9, it is advantageously possible to fit standard rail fixing elements 28 with anchoring parts 43 known from the prior art and to fit them by means of the mounting devices 26 disposed eccentrically with respect to the sleeper longitudinal axis 6 of the sleeper 1.

In another embodiment, although this is not illustrated, the bearing 9 may extend along the longitudinal members 5 by the bearing length 37 across the entire sleeper width 14*b*, in which case the fixing and clamping points 27 with the mounting devices 26 can be distributed across the entire sleeper width 14*b* adjacent to the bearings 9.

Other embodiments with regard to the layout of the mounting devices 26 will be described later in connection with FIGS. 4 to 6.

As illustrated in FIG. 3, another independent solution proposed by the invention is one in which the longitudinal members 5 are each stepped or recessed at least at one but preferably at both the oppositely lying end regions 45*a*, 45*b* underneath where the rail element 10 is to be positioned, i.e. the longitudinal members 5 have an offset or a recess in their top face in the direction towards the sleeper bottom face 2.

The longitudinal projections 20, 21 projecting beyond the cross member 4 by the distance 19 each have a step 47*a*, 47*b* at the stepped end regions 45*a*, 45*b*, which may lie against end faces 46*a*, 46*b* extending parallel with the sleeper longitudinal axis 6, and these extend from a step edge 49 disposed on the support surface 33 spaced at a height 50 from it across a step length 51 along the longitudinal extension of the longitudinal member 5. In the embodiment illustrated as an example, a step width 52 of the steps 47*a*, 47*b* extends across the entire width of the longitudinal member 5 and longitudinal projections 20, 21. However, it would also be possible for the steps 47*a*, 47*b* to extend across only a part of the width of the longitudinal member 5 and longitudinal projections 20, 21, in which case the steps 47*a*, 47*b* are provided in the form of a recess or depression in the longitudinal member 5 extending only in the region of the longitudinal mid-axis 8 of the longitudinal member 5, for example.

The step width 52 of the steps 47*a*, 47*b* may at least correspond to the rail width 36 of a rail element 10 but may also be bigger than a channel distance 53 between the outer edges of two mounting channels 41 lying opposite the sides 31, 32 on the longitudinal member 5. Accordingly, a gap 55 extends between a shoulder surface 54 of the steps 47*a*, 47*b* which may extend in an essentially parallel arrangement along the top face of the steps 47*a*, 47*b* or which may be convex with respect to the plane of extension of the sleeper 1 and the bottom face 11 of a rail element 10 lying on the bearing 9 in the mounted state.

This gap 55 enables connecting elements 56 to be fitted between two rail elements 10. These connecting elements 56 are needed in order to connect two individual rail elements 10 and have to be fitted during the process of laying the railway track depending on the terrain or course of the track to connect individual rail elements 10. Due to the stepped or recessed design in the region of the end faces 46*a*, 46*b* of the longitudinal member 5, the bottom faces 11 are also accessible in a connecting region 57 of the rail elements 10 via the gap 55 exposed at the end faces 46*a*, 46*b* so that the connecting elements 56 can be fitted between the rail elements 10 using appropriate tools. In this respect, it should be pointed out that using sleepers with longitudinal members known from the prior art until now, the support surface 33 extends continuously without any stepping, which has made it very difficult to or even impossible to connect two rail elements between two adjacent sleepers of this type because the bottom face of the rail elements was not accessible for connection tools. Sleepers with longitudinal members could therefore not be used in these connecting regions. With regard to the shoulder surface 54 on the steps 47*a*, 47*b* or the recess, it should be pointed out that these may be planar or curved, in particular provided in the manner of a depression or similar and may also be profiled or structured if necessary.

The connecting element 56 for connecting two individual rail elements 10 is usually provided in the form of a welded seam in the prior art. For example, the space between two rail elements 10 in the connecting region 57 is filled with a molten material, which then constitutes the connecting element 56 once it has solidified, and a tool or moulding may be placed underneath two rail elements 10 to be connected in the connecting region 57 above the steps 47*a*, 47*b* of the sleeper 1 during processing to prevent the molten material from unintentionally draining away.

FIG. 3 illustrates another sleeper 1 intended to show the layout of two adjacent sleepers 1 in the laid state. As illustrated, the adjacent steps 47*a*, 47*b* of two sleepers 1 can be used to connect two rail elements 10 in the connecting region 57 disposed between the sleepers 1. The bearing surface 23 extends along the sleeper bottom face 2, including at the end regions 45*a*, 45*b* of the longitudinal member 5, in the same way, in particular in flat abutment with the other sleeper bottom face 2.

With regard to the disposition of the bearing 9 on the respective longitudinal members 5, the bearing surface 12 is spaced apart from the support surface by a bearing height 58. As a result, a gap 59 is formed between the bottom face 11 of a rail element 10 placed on the bearing 9 and the support surface 33, which gap 59 preferably has only a small extension along the extension of the rails, in which case the gap 59 is formed in the immediate vicinity of the step edges 59 only. It should be pointed out that it is not possible to fit connecting elements 56 through the gap 59 because the bearing height 58 is too low, as has been the case with the prior art in the past.

The sleeper width 14*b* or support length of the longitudinal members 5 of each sleeper 1 extends across a dimension which is at least slightly smaller than a sleeper distance 60 between the individual sleepers 1. An intermediate region 61 is therefore formed between two adjacent sleepers 1, which extends along the extension of the rails by a dimension 62. Since the sleeper distance 60 is limited to a fixed sized in railway construction in order to permit use of standard laying and packing technology, the sleeper width 14*b* of the sleepers 1 may be constant for all application situations. For example, the sleeper distance 60 used in railway construction is approximately. 60 cm, which means that the sleeper width 14*b* has a smaller dimension than 60 cm, e.g. 56 cm, and a dimension 62 of the intermediate region 61 would be 4 cm. The stepped longitudinal members 5 of the sleepers 1 proposed by the invention therefore permit rail welding in the sleeper distance 60, i.e. in the distance of 60 cm for example.

With regard to the geometry of the longitudinal member 5s, it should be pointed out that the support surface 33 on the top face of the longitudinal member 5 on which the mounting devices 26 and the bearing 9 are mounted, is higher than the steps 47*a*, 47*b* and preferably than a top face 63 of the cross member 4 and transverse extensions 13. Raised in this manner, the support surface 33 projects in the extension along the longitudinal mid-axis 8 of the longitudinal member 5 beyond the cross member 4 by the protuberance 44, and the mounting channels 41 and the recess 38 preferably project beyond the cross member 4 accordingly and are preferably also of a continuous design corresponding to the bearing length 37, as described above.

Figure 4:
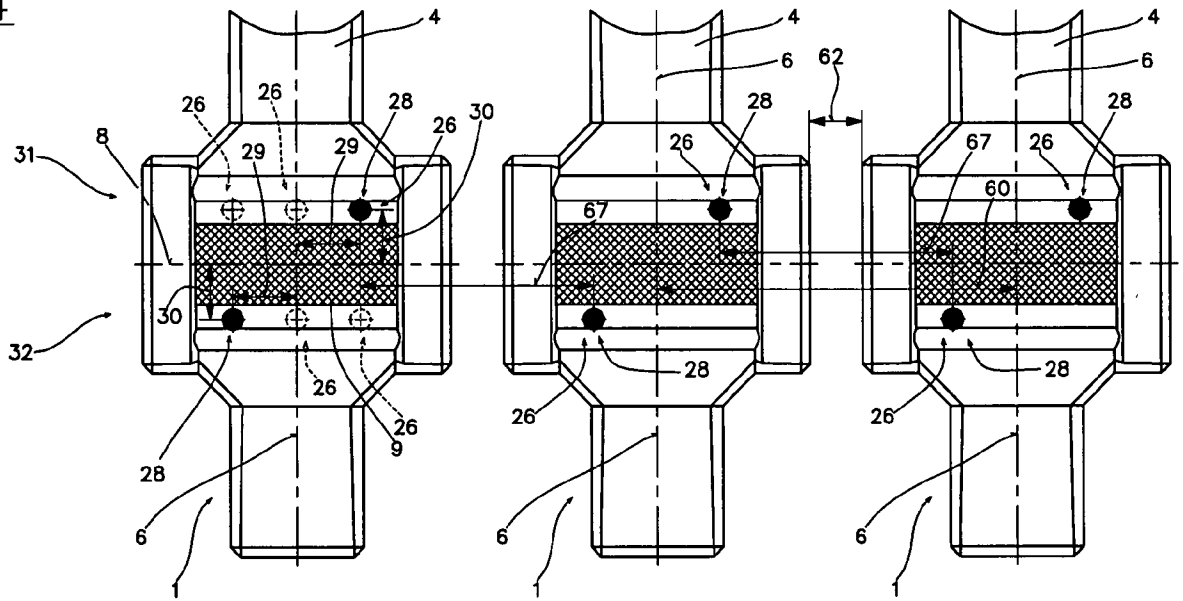
FIG. 4 is a plan view showing several sleepers of one possible embodiment, laid.

FIG. 4 illustrates one possible variant of a sleeper 1, although only one longitudinal member 5 of several adjacent sleeper 1 in the laid state is illustrated. With regard to the variants illustrated in FIGS. 4 to 6, it should be pointed out that the mounting devices 26 as well as the rail fixing elements 28 are illustrated in a schematic format only. The solid circles represent the positions of the rail fixing elements 28 disposed in the mounting devices 26 for securing a rail element 10 at appropriate fixing and clamping points 27. The circles in FIG. 4 shown by dotted-dashed lines on one of the sleepers 1 represent "passive" mounting devices 26, which do not fix a rail fixing element 28 and these "passive" mounting devices 26 are illustrated on one of the sleepers 1 purely by way of example.

In the case of the embodiment illustrated, two mounting devices 26 each with a rail fixing element 28 are disposed diagonally opposite one another. The mounting devices 26 respectively lie spaced apart from the sleeper longitudinal axis 6 of the sleeper 1 by the distance 29 and from the longitudinal mid-axis 8 of the longitudinal member 5 by the distance 30, in which case the two mounting devices 26 are respectively spaced apart from one another in opposite directions by the distances 29, 30.

With regard to the layout of the mounting devices 26 generally speaking, it should be pointed out that, as illustrated, at least one but preferably three mounting devices 26 may be provided at each side 31, 32 of the longitudinal mid-axis 8 of the longitudinal member 5. Accordingly. on at least one of the sides 31, 32 adjacent to the longitudinal mid-axis 8, a mounting device 26 is spaced apart from the sleeper longitudinal axis 6 of the sleeper 1 by the distance 29.

As indicated by some of the broken lines in the preceding drawings and in FIG. 4, three mounting devices 26 may respectively be disposed parallel with the longitudinal mid-axis 8 of the longitudinal member 5 adjacent to the bearing 9. A rail fixing element 28 can now be positioned and secured on each of these mounting devices 26. During the manufacturing process, the sleeper 1 may already be provided with the rail fixing elements 28 on the mounting devices 26 or the mounting devices 26 may be fitted with one of the requisite number of rail fixing elements 28 subsequently, depending on requirements, for example during construction of the railway line. The number and distribution of rail fixing elements 28 on the mounting devices 26 on the longitudinal member 5 may therefore be varied. For example, each longitudinal member 5 has six mounting devices 26, on which different layouts of rail fixing elements 28 can be obtained on the longitudinal member 5.

The individual mounting devices 26 are preferably designed so that they can each be deactivated or transferred into the "passive position" (indicated by broken lines), which can be done by closing the anchoring orifice 40, for example. To this end, the anchoring orifices 40 are each designed to accommodate a closure element 66 if necessary (see FIG. 1). Consequently, every mounting device 26 that is not required can be deactivated or transferred to the passive position. When the anchoring orifices 40 are in the non-closed state, they are in the active or mounting position and are suitable for accommodating the rail fixing elements 28.

The sleeper 1 can therefore be adapted to cater for different load situations resulting from the terrain, transport load, speed of the rail vehicle, etc. The closure element 66 is preferably provided in the form of a plug made from plastic in particular, which can be introduced into the anchoring orifice 40 and removed from it again if necessary.

In principle, the strength of the railway in the mounted state can be increased by a distribution of the mounting devices 26 with the rail fixing elements 28 on the longitudinal member 5 along the extension of the rail element 10 as proposed by the invention and the resistance to lateral shifting improved because a fixing distance 67 between adjacent rail fixing elements 28 of two adjacent sleepers 1 is not determined by the sleeper distance 60 and instead, the fixing distance 67 between two rail fixing elements 28 in the direction in which the rails extend may be shorter than the sleeper distance 60.

Naturally it would also be possible for the sleeper 1 to be designed to cater for a special load situation, in which case it will have a set number and layout of rail fixing elements 28 on the longitudinal member 5 specifically for this purpose.

Figure 5:
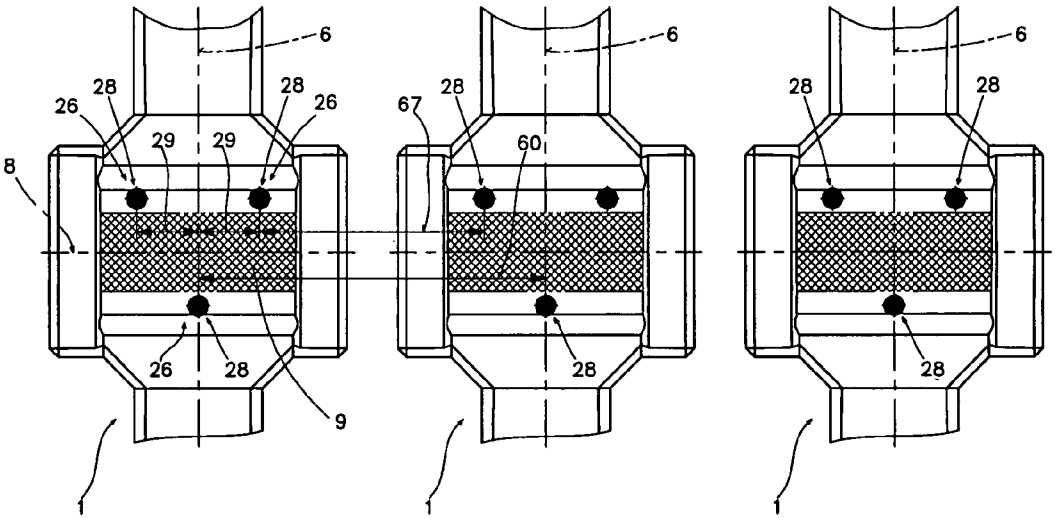
FIG. 5 is a plan view showing several sleepers of another possible embodiment, laid.

FIG. 5 illustrates another possible embodiment of a sleeper 1, where the layout of the mounting devices 26 and the fixing and clamping points 27 on the longitudinal member 5 essentially runs in a triangular shape.

Disposed at the first side 31 adjacent to the longitudinal mid-axis 8 of the longitudinal member 5 are two mounting devices 26 each with a rail fixing element 28, which are respectively spaced apart from the sleeper longitudinal axis 6 in opposite directions by the distance 29. The mounting devices 26 are preferably spaced apart from one another by the same distance 29 although these distances 29 may also be different. At the other side 32 of the longitudinal member 5, on the other had, there is only one mounting device 26 with a rail fixing element 28, which is disposed on the longitudinal member 5 in the extension along the longitudinal mid-axis 8 in the region of the sleeper longitudinal axis 6 of the sleeper 1, in particular in the middle region of a sleeper width 14*b* of the sleeper 1.

A triangular layout of this type is of advantage because the fixing distance 67 between the adjacent mounting devices 26 of two adjacent sleepers 1 is in turn shorter than the sleeper distance 60 and a higher resisting force against displacement of the rail element 10 can be applied by using three mounting devices 26 per longitudinal member 5, and the rail element 10 is positioned in the transverse direction following the extension of the sleeper longitudinal axis 6 of the sleeper 1. This layout of the mounting devices 26 and rail fixing elements 28 is particularly suitable for laying radii in the railway track, in which case the side 31 of the two longitudinal members 5 each with two rail fixing elements 28 may lie on a radius inner side facing a centre of the radius of curvature or on a radius outer side remote from it.

It should generally be pointed out that on both longitudinal members 5 of a sleeper 1, the layout and/or number of rail fixing elements 28 is preferably identical and symmetrical. It is also possible for the layout of the rail fixing elements 28 on the two longitudinal members 5 to be different from one another or non-symmetrical, in other words one of the longitudinal members 5 may have a different layout of rail fixing elements 28 on one or both sides 31; 32 adjacent to its longitudinal mid-axis 8 than the other longitudinal member 5.

Figure 6:
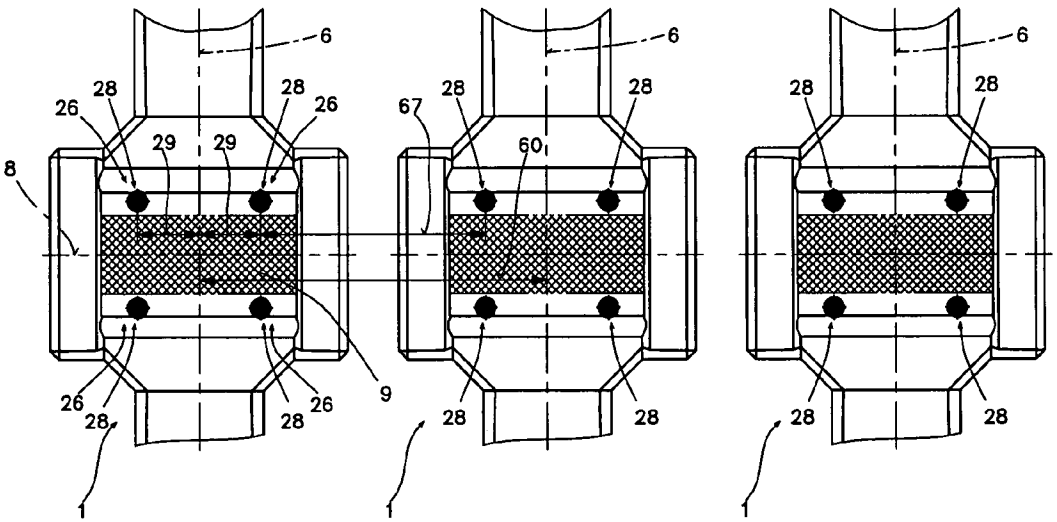
FIG. 6 is a plan view showing several sleepers of yet another possible embodiment, laid.

FIG. 6 illustrates another embodiment of the sleeper 1, with four mounting devices and fixing and clamping points 27 per longitudinal member 5.

On each longitudinal member side 31, 32 adjacent to the longitudinal mid-axis 8 of the longitudinal member 5, two of the mounting devices 26 each with a rail fixing element 28 are provided, and these are spaced apart from one another by the distance 29 on each side 31, 32 to form respective opposite pairs. The advantage of the eccentric disposition of the fixing element 26 relative to the sleeper longitudinal axis 6 of the sleeper 1 is that a shorter fixing distance 67 is obtained between two longitudinal members 5 of adjacent sleepers, and the larger number of rail fixing elements 28 on the longitudinal members 5 enables the sleeper 1 to be used for applications involving higher loads, for example uphill sections.

With the rectangular or four-point layout of the rail fixing elements 28 illustrated in FIG. 6, it is naturally also possible to provide another rail fixing element 28 in the middle region of the sleeper 1 in the region of the sleeper longitudinal axis 6 respectively adjacent to the bearing 9, in which case six rail fixing elements 28 will be provided on the mounting devices 26 per longitudinal member 5.

The embodiments illustrated as examples represent possible design variants of the sleeper 1 and it should be pointed out at this stage that the invention is not specifically limited to the design variants specifically illustrated, and instead the individual design variants may be used in different combinations with one another and these possible variations lie within the reach of the person skilled in this technical field given the disclosed technical teaching. Accordingly, all conceivable design variants which can be obtained by combining individual details of the design variants described and illustrated are possible and fall within the scope of the invention.

For the sake of good order, finally, it should be pointed out that in order to provide a clearer understanding of the structure of the sleeper 1, it and its constituent parts are illustrated to a certain extent out of scale and/or on an enlarged scale and/or on a reduced scale.

The objective underlying the independent inventive solutions may be found in the description.

Above all, the individual embodiments of the subject matter illustrated in FIGS. 1, 2, 3; 4; 5; 6 constitute independent solutions proposed by the invention in their own right. The objectives and associated solutions proposed by the invention may be found in the detailed descriptions of these drawings.

| List of reference numbers | |
|---|---|
| 1 | Sleeper |
| 2 | Sleeper bottom face |
| 3 | Gravel bed |
| 4 | Cross member |
| 5 | Longitudinal member |
| 6 | Sleeper longitudinal axis |
| 7 | Distance |
| 8 | Longitudinal mid-axis |

-continued

| List of reference numbers | |
|---|---|
| 9 | Bearing |
| 10 | Rail element |
| 11 | Bottom face |
| 12 | Bearing surface |
| 13 | Tranverse extension |
| 14a | Sleeper length |
| 14b | Sleeper width |
| 15 | Cross member length |
| 16 | Width |
| 17 | Intersecting region |
| 18 | Side face |
| 19 | Distance |
| 20 | Longitudinal projection |
| 21 | Longitudinal projection |
| 22 | External contour |
| 23 | Bearing surface |
| 24 | Top face |
| 25 | Damping mat |
| 26 | Mounting device |
| 27 | Fixing and clamping point |
| 28 | Rail fixing element |
| 29 | Distance |
| 30 | Distance |
| 31 | Side |
| 32 | Side |
| 33 | Support surface |
| 34 | Damping element |
| 35 | Bearing width |
| 36 | Rail width |
| 37 | Bearing length |
| 38 | Recess |
| 39 | Bolt |
| 40 | Anchoring orifice |
| 41 | Mounting channel |
| 43 | Anchoring part |
| 44 | Protuberance |
| 45a | End region |
| 45b | End region |
| 46a | End face |
| 46b | End face |
| 47a | Step |
| 47b | Step |
| 49 | Step edge |
| 50 | Height |
| 51 | Step length |
| 52 | Step width |
| 53 | Channel distance |
| 54 | Shoulder surface |
| 55 | Gap |
| 56 | Connecting element |
| 57 | Connecting region |
| 58 | Bearing height |
| 59 | Gap |
| 60 | Sleeper distance |
| 61 | Intermediate region |
| 62 | Dimension |
| 63 | Top face |
| 66 | Closure element |
| 67 | Fixing distance |

The invention claimed is:

1. A double-cross sleeper for a gravel-mounted structure on railways, the double-cross sleeper comprising:

(a) a cross member extending along a sleeper longitudinal axis, said cross member comprising first and second cross member side faces;

(b) a first longitudinal member extending along a first longitudinal mid-axis at a right angle to the sleeper longitudinal axis, said first longitudinal member comprising a first top face, a first bearing on the first top face, first, second and third mounting devices on a first side of the first longitudinal mid-axis, fourth, fifth and sixth mounting devices along a second side of the first longitudinal mid-axis, a first bottom face, a first stepped design in the direction of the first bottom face at the first topped face at a first end region, a third stepped design in the direction of the first bottom face at the first topped face at a third end region, and first and third longitudinal projections extending out along the first longitudinal mid-axis beyond the first and second cross member side faces respectively in a first intersecting region between the first longitudinal member and the cross member;

(c) a second longitudinal member extending along a second longitudinal mid-axis at a right angle to the sleeper longitudinal axis, said second longitudinal member comprising a second top face, a second bearing on the second top face, seventh, eighth and ninth mounting devices on a first side of the second longitudinal mid-axis, tenth, eleventh and twelfth mounting devices along a second side of the second longitudinal mid-axis, a second bottom face, a second stepped design in the direction of the second bottom face at the second topped face at a second end region, a fourth stepped design in the direction of the second bottom face at the second topped face at a fourth end region, and second and fourth longitudinal projections extending out along the second longitudinal mid-axis beyond the first and second cross member side faces respectively in a second intersecting region between the second longitudinal member and the cross member; and (d) first and second sleeper end regions along the sleeper longitudinal axis lateral to the first and second longitudinal members respectively, said first sleeper end region comprising a first extension transverse to the first longitudinal member, said second sleeper end region comprising a second extension transverse to the second longitudinal member;

wherein said first end region and said third end region lie opposite to each other across the sleeper longitudinal axis;

wherein said second end region and said fourth end region lie opposite to each other across the sleeper longitudinal axis;

wherein each mounting device is for an associated rail fixing element, the rail fixing elements associated with the first, second, third, fourth, fifth and sixth mounting devices retaining a first rail element on the first longitudinal member, the rail fixing elements associated with the seventh, eighth, ninth, tenth, eleventh and twelfth mounting devices retaining a second rail element on the second longitudinal member;

wherein the respective rail element can be mounted on the first and second longitudinal members, respectively, by the first and second bearing, respectively, to extend above the first and second longitudinal members, respectively;

wherein at least one of the mounting devices is disposed transversely offset with respect to the sleeper longitudinal axis;

wherein the first longitudinal member has a first width;

wherein the second longitudinal member has a second width;

wherein the first bearing has a first bearing length;

wherein the second bearing has a second bearing length; and wherein at least one of the first bearing length and the second bearing length is at least ⅔ of the first longitudinal member width or the second longitudinal member width, respectively.

2. The double-cross sleeper as claimed in claim 1, wherein at least one mounting devices is eccentrically disposed on the respective first or second longitudinal member within the first longitudinal width or the second longitudinal width, respectively.

3. The double-cross sleeper as claimed in claim 1, wherein the first mounting device and the fourth mounting device are offset from one another parallel with the sleeper longitudinal axis.

4. The double-cross sleeper as claimed in claim 1, wherein the first and second bearings extend on the first and third longitudinal projections and on the second and fourth longitudinal projections, respectively;

wherein the first mounting device and the fourth mounting device are disposed adjacent to the first bearing on oppositely lying sides of the first longitudinal member.

5. The double-cross sleeper as claimed in claim 1, wherein the first longitudinal projection contains the first end region;

wherein the second longitudinal projection contains the third end region;

wherein the first and third stepped designs comprise a first and second step, respectively;

wherein the first and second steps comprise a first shoulder surface and a second shoulder surface, respectively; and wherein the first and second shoulder surfaces are each remote from the first bottom face.

6. The double-cross sleeper as claimed in claim 5, wherein the first longitudinal member further comprises a support surface on the first top face; and wherein the first shoulder surface is spaced apart from the support surface by a height in the direction of the first bottom face.

7. The double-cross sleeper as claimed in claim 5, wherein the first shoulder surface is essentially of a rectangular or elliptical shape.

8. The double-cross sleeper as claimed in claim 5, wherein the first and second steps have a first step width and a second step width, respectively;

wherein the first bearing has a bearing width; and wherein said first step width and said second step width each correspond to at least the bearing width.

9. The double-cross sleeper as claimed in claim 4, wherein the first and fourth mounting devices comprise a first mounting channel and a second mounting channel, respectively;

wherein the first longitudinal member further comprises a support surface on the first top face; and wherein the first and second mounting channels are provided in the form of a first and second recess, respectively, in the support surface.

10. The double-cross sleeper as claimed in claim 9, wherein the first and second mounting channels extend continuously or are split into part sections across the support surface and are parallel with the first longitudinal mid-axis.

11. The double-cross sleeper as claimed in claim 9, wherein the first and second mounting channels project beyond the cross member by a protuberance.

12. The double-cross sleeper as claimed in claim 9, wherein a support width of the first longitudinal member in the region of the support surface corresponds to at least a channel distance between the first and second mounting channels.

13. The double-cross sleeper as claimed in claim 1, wherein the mounting devices can be deactivated by receiving a closure element.

14. The double-cross sleeper as claimed in claim 1, wherein each mounting device comprises a respective anchoring orifice.

15. The double-cross sleeper as claimed in claim 14, wherein the anchoring orifice of each mounting device is closable by a respective closure element in order to deactivate the mounting device.

16. The double-cross sleeper as claimed in claim 1, wherein the first and fourth mounting devices with the associated rail fixing elements are spaced apart from the sleeper longitudinal axis in opposite directions from one another by a distance.

17. The double-cross sleeper as claimed in claim 1, wherein the first and sixth mounting devices with the associated rail fixing elements are disposed diagonally opposite one another.

18. The double-cross sleeper as claimed in claim 1, wherein the second mounting device is disposed between the first and third mounting devices.

19. The double-cross sleeper as claimed in claim 1, wherein the first and fourth mounting devices are spaced apart from the sleeper longitudinal axis in opposite directions respectively by an identical or different distance.

20. The double-cross sleeper as claimed in claim 1, wherein the first stepped design comprises a first step edge;

wherein the third stepped design comprises a second step edge; and wherein the first bearing extends continuously on the first longitudinal member between the first and second step edges.

* * * * *

UNITED STATES PATENT AND TRADEMARK OFFICE

CERTIFICATE OF CORRECTION

PATENT NO. : 7,841,543 B2
APPLICATION NO. : 10/589634
DATED : November 30, 2010
INVENTOR(S) : Hermann Gruber It is certified that error appears in the above-identified patent and that said Letters Patent is hereby corrected as shown below:

Column 15, line 15, after the word "in" change "claim 1" to claim 4

Signed and Sealed this
Twenty-ninth Day of March, 2011

David J. Kappos

David J. Kappos
*Director of the United States Patent and Trademark Office*